US008590715B2

(12) United States Patent
Gray

(10) Patent No.: US 8,590,715 B2
(45) Date of Patent: Nov. 26, 2013

(54) BEVERAGE SERVICE RACK

(76) Inventor: Silvio R. Gray, Mount Prospect, IL (US)

( * ) Notice: Subject to any disclaimer, the term of this patent is extended or adjusted under 35 U.S.C. 154(b) by 98 days.

(21) Appl. No.: 13/373,468

(22) Filed: Nov. 16, 2011

(65) Prior Publication Data

US 2013/0119005 A1 May 16, 2013

(51) Int. Cl.
*A47F 7/28* (2006.01)
*A47F 5/04* (2006.01)

(52) U.S. Cl.
USPC .... 211/85.18; 211/85.31; 211/75; 211/181.1; 211/196

(58) Field of Classification Search
USPC ..... 211/85.18, 85.31, 75, 85.29, 196, 205, 211/85.4, 181.1, 74, 71.01, 133.4, 125; 248/175, 363, 311.3; 206/501–505, 206/507, 508; 220/743, 737, 487, 495, 494; D7/401.2, 701, 637, 704–708, 600.1; D6/409–415, 449, 454–458, 461–469, D6/509–511
See application file for complete search history.

(56) References Cited

U.S. PATENT DOCUMENTS

| | | | | | |
|---|---|---|---|---|---|
| 614,565 | A | * | 11/1898 | Marshall | 211/86.01 |
| 953,007 | A | * | 3/1910 | Haller | 211/71.01 |
| 1,445,029 | A | * | 2/1923 | Orrill | 211/65 |
| 1,448,259 | A | * | 3/1923 | Cook | 294/143 |
| 1,643,735 | A | * | 9/1927 | Baker | 211/85.4 |
| 2,140,743 | A | * | 12/1938 | Heymann | 211/74 |
| D130,234 | S | * | 11/1941 | Planeta | D7/704 |
| D152,826 | S | * | 2/1949 | Raysik | D7/704 |
| D165,303 | S | * | 11/1951 | Rogers et al. | D7/706 |
| D166,528 | S | * | 4/1952 | Cole | D6/458 |
| 3,142,425 | A | * | 7/1964 | Cobb | 294/159 |
| D204,718 | S | * | 5/1966 | Marchetti | D6/458 |
| 3,888,348 | A | * | 6/1975 | Frey | 206/427 |
| 3,908,877 | A | * | 9/1975 | Kosisky | 294/143 |
| D279,444 | S | * | 7/1985 | McDonald | D6/511 |
| 5,715,953 | A | * | 2/1998 | Brown | 211/74 |
| D392,163 | S | * | 3/1998 | Jenkinson | D7/704 |
| 5,772,050 | A | * | 6/1998 | Shih | 211/39 |
| 5,833,080 | A | * | 11/1998 | Donne | 211/85.31 |
| D401,819 | S | * | 12/1998 | Doret, Jr. | D7/600.2 |
| D404,919 | S | * | 2/1999 | McCorkle, Jr. | D3/315 |
| 6,244,554 | B1 | * | 6/2001 | Baker | 248/312 |
| 6,595,377 | B1 | * | 7/2003 | Hetu | 211/85.23 |
| D482,212 | S | * | 11/2003 | Nakaoka | D6/464 |
| D483,579 | S | * | 12/2003 | Frankelton | D6/462 |
| D489,587 | S | * | 5/2004 | Herzog | D7/704 |
| D512,282 | S | * | 12/2005 | Martin | D7/707 |
| D536,936 | S | * | 2/2007 | Tiemann | D7/704 |
| D547,621 | S | * | 7/2007 | Ku | D7/704 |
| 7,275,647 | B1 | * | 10/2007 | Thompson | 211/85.18 |
| D559,050 | S | * | 1/2008 | Mungal | D7/704 |
| 7,334,908 | B1 | * | 2/2008 | Figueroa | 362/101 |
| D566,480 | S | * | 4/2008 | Lawler | D7/620 |
| D587,076 | S | * | 2/2009 | Grady | D7/704 |
| 7,562,785 | B2 | * | 7/2009 | Meissen | 220/6 |
| D618,525 | S | * | 6/2010 | Garnero et al. | D7/706 |
| D634,978 | S | * | 3/2011 | Tiemann | D7/600.4 |

(Continued)

*Primary Examiner* — Jennifer E Novosad
(74) *Attorney, Agent, or Firm* — Gregory B. Beggs

(57) ABSTRACT

A rack for carrying or displaying glassware or similar containers holding liquids such as beverages is disclosed. The rack has a planar portion, which may be defined by concentrically arranged wire rings, that supports several yokes around its outer edge. The yokes grasp the containers between outwardly extending arm segments. A straight post handle is joined to the center of the underside of the planar portion of the rack.

4 Claims, 7 Drawing Sheets

(56) References Cited

U.S. PATENT DOCUMENTS

| | | | | |
|---|---|---|---|---|
| 7,984,813 | B1 * | 7/2011 | Tapager | 211/74 |
| D651,454 | S * | 1/2012 | Chin | D7/401.2 |
| 2002/0027366 | A1 * | 3/2002 | Bieri | 294/159 |
| 2002/0036178 | A1 * | 3/2002 | Tombu | 211/74 |
| 2003/0160013 | A1 * | 8/2003 | Tellefsen | 211/85.29 |
| 2006/0261020 | A1 * | 11/2006 | Braen et al. | 211/85.29 |
| 2008/0061020 | A1 * | 3/2008 | Kaisler | 211/196 |
| 2008/0173600 | A1 * | 7/2008 | Mungal | 211/71.01 |

* cited by examiner

BEVERAGE SERVICE RACK

FIELD OF THE INVENTION

This invention relates to beverage service racks which protect liquid beverages from being spilled when a waitress is accidentally bumped as she is carrying a tray of beverages to a customer's table. More particularly, it relates to beverage service racks which facilitate carrying glasses of beverages securely, are light weight themselves, and can also be used to display beverages and food items from a tree type of support or mounting. The racks of the present invention are easily disassembled and stored by separating a handle portion attached to the underside of the rack from the tray portion.

BACKGROUND OF THE INVENTION

A variety of food and beverage racks are illustrated in the prior art.

One is shown in U.S. Pat. No. 1,643,735. That patent describes a cardboard disk which incorporates several holes to rest ice cream cones in. There is a reinforcing rim around the disk's perimeter. A cone purchaser carries them away in the disk and discards it after it has served its purpose.

Another form of rack is shown in U.S. Pat. No. 7,334,908. A section around the rim of an Ice bucket contains notches for hanging beverage vessels. The ice bucket itself is held in the upright forks on a floor stand.

An ornamental design for the top of a table is shown in U.S. Pat. No. Des. 279,444. The design combines an upper disk with several circular openings with a lower disk which has matching circular openings. The upper and lower disks are separated by a centrally located spacer, and this assembly is attached to a supporting rod or group of rods joined to the lower disk.

A circular solid tray is shown in U.S. Pat. No. 3,908,877 which incorporates several holes holding beverage cups. Legs on the underside of the tray are longer than the extent of the cups and support the tray. A handle for lifting the assembly extends upwardly from the tray.

Another circular plate with holes in it for beverage cups is shown in U.S. Pat. No. 3,142,425. A pistol grip handle is attached to the underside of the plate and is located just below one edge of the plate and supports it along one edge. Tabs at the forward ends of arms extending toward the central underside of the plate are locked into slots in the plate.

Still another circular plate for holding beverage cups and bottles is shown in United States Application No. 2002/0027366. Cups formed in the plate accept the beverage holders and bottles. The plate has somewhat D-shaped handles extending out from underneath opposite sides of the plate.

All of these servers are formed with relatively solid inner plate sheet material which makes them cumbersome to carry and difficult to store. The present invention is directed to alleviating those problems.

SUMMARY OF THE INVENTION

The present invention is an open tray for carrying glasses securely and displaying them readily. Concentrically arranged ring members, which may be wire, support several yokes on an outer ring for holding and displaying glasses, and a centrally located ring may be utilized to engage, hold and display a dish of a food item accompanying the glasses. The yokes extend outwardly from the outer ring and grasp the beverage glasses in arm segments. A space between the ends of the arm segments admits stem portions of beverage glasses formed in that manner and the cup portions of the glasses are nested securely in the arms. A straight post handle is joined to the center of the underside of the tray so that a waitress can grasp it immediately beneath the tray and support the tray with a closed hand and forearm while it is being carried.

DETAILED DESCRIPTION OF THE PREFERRED EMBODIMENTS

Figure 1:
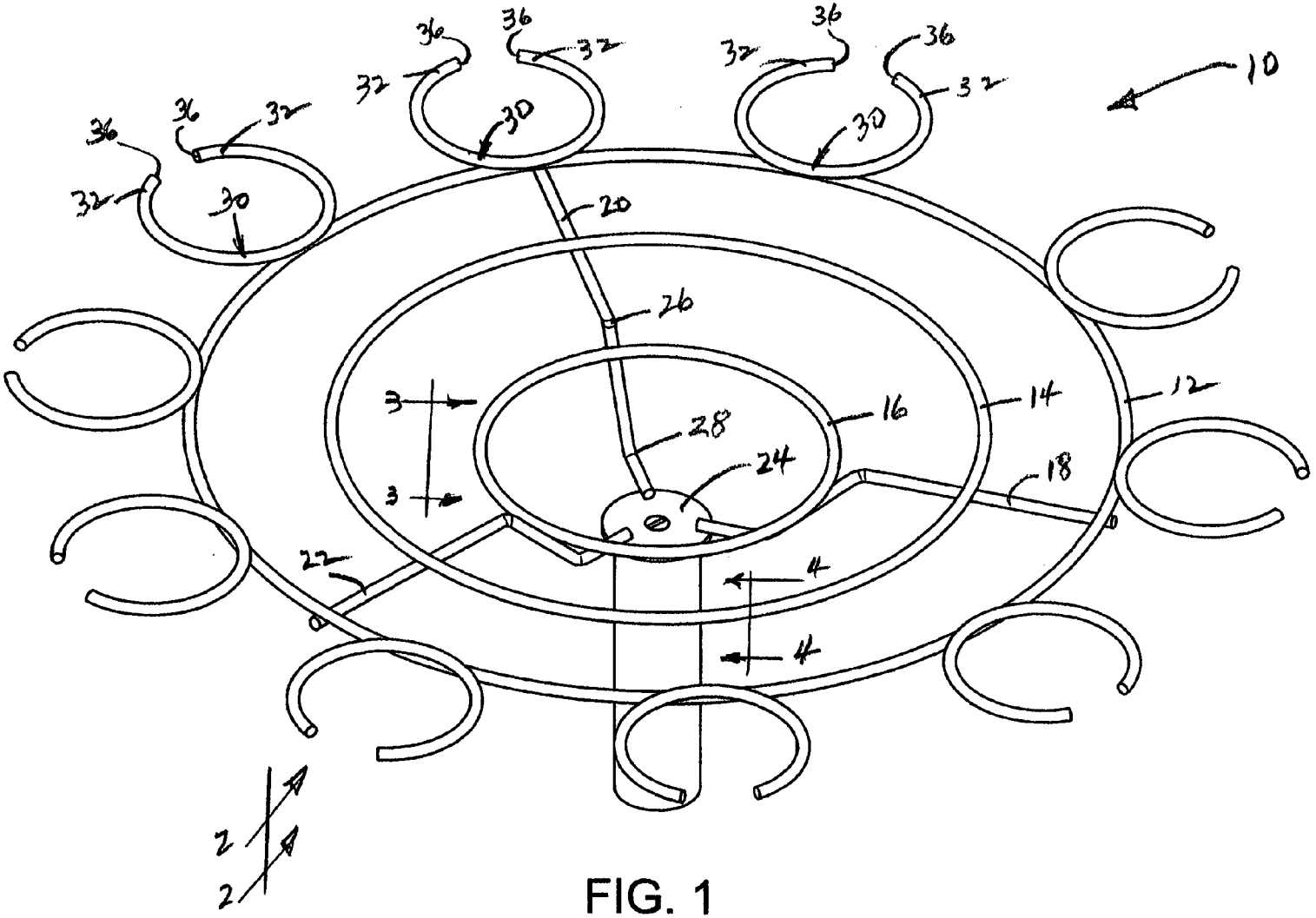
FIG. 1 is a perspective view of the beverage service rack embodying the present invention.

Referring more particularly to the drawings, the beverage service rack 10 of this invention is shown in perspective completely assembled in FIG. 1. The rack is comprised of two portions, a tray portion 10A and a handle portion 44. Three wire rings 12, 14 and 16 form a substantially planar deck, or tray portion, of the rack. The outer ring 12 and the middle ring 14 are in approximately the same first plane, and the inner ring 16 lies in a second plane which is closely parallel to and below the first plane.

Figure 3:
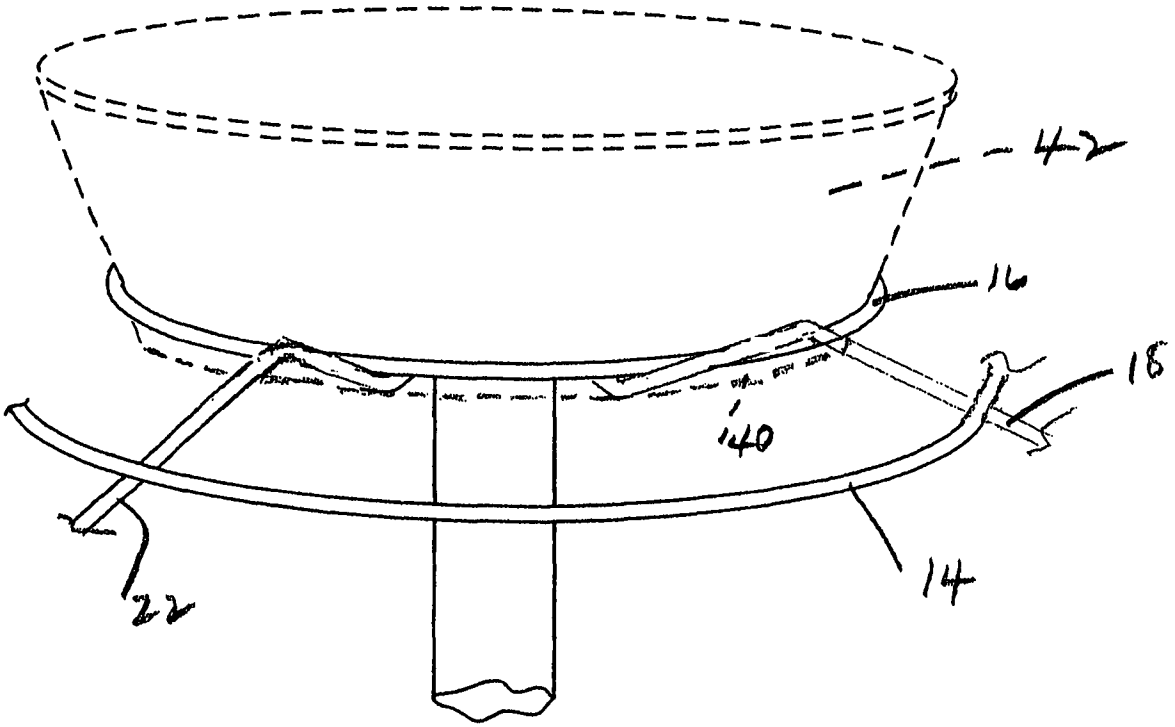
FIG. 3 is an enlarged view in perspective of a portion of the beverage service rack in FIG. 1 taken in the direction of arrows 3-3 in FIG. 1 and also showing a bowl for a food item in phantom.

Wire supporting arms 18, 20 and 22 extend outwardly from a washer shaped disk 24 located below the inner ring 16. The disk 24, located substantially concentrically with respect to the rings 16, 14 and 12, forms a hub for the wire arms 18, 20 and 22 which are attached to it and extend radially away from it. The arms 18, 20 and 22 are connected to all three rings. They support rings 12 and 14 at the same level and support the inner ring 16 at a level which is slightly below 12 and 14. Each of the arms includes a depending section formed between angular bends, as at 26 and 28 for arm 20, in order to support the rings at their respective levels. The ring 16 is also supported slightly above disk 24, thus providing a space to accommodate a base portion 40 of a bowl 42 (see FIG. 3) and hold the bowl on the tray portion as the beverage service rack is being carried or displayed.

Figure 2:
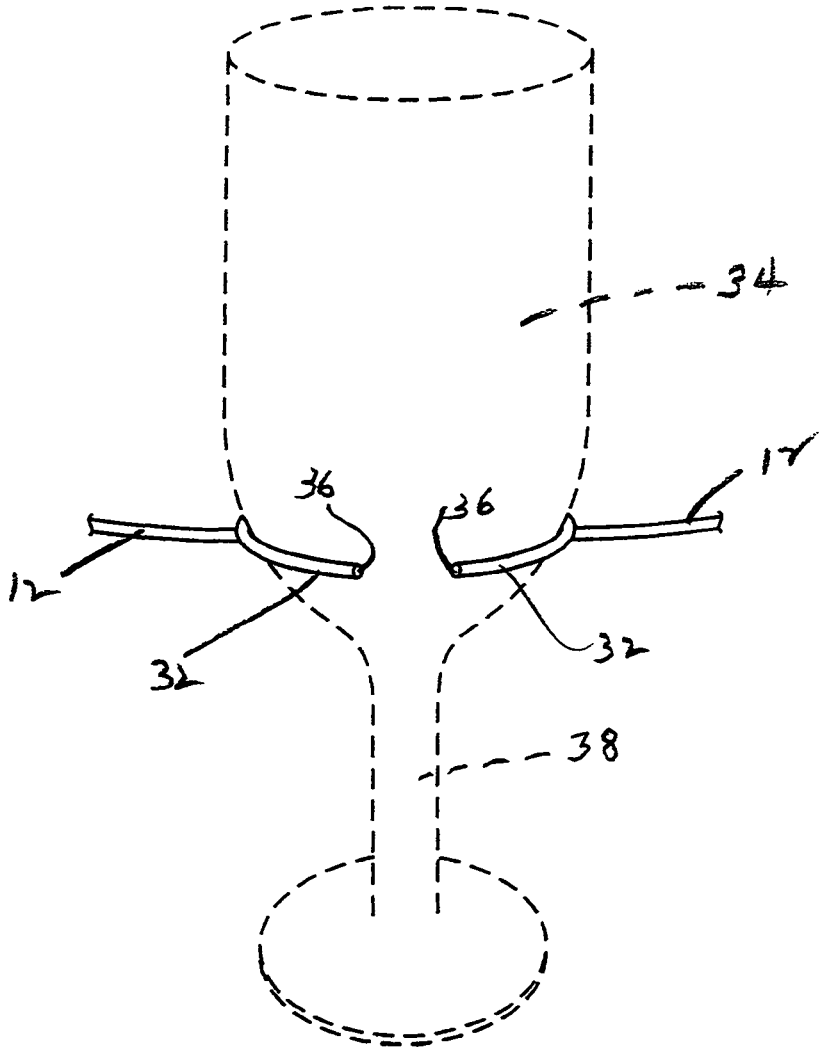
FIG. 2 is an enlarged view in perspective of a portion of the beverage service rack in FIG. 1 taken in the direction of arrows 2-2 in FIG. 1 and also showing a beverage glass being held in phantom.

A plurality of wire yokes 30 are mounted on the outer ring 12 and extend outwardly from the concentrically arranged rings 12, 14 and 16. The yokes have arm segments 32 which are configured to receive and support cylindrical beverage holders such as the glass 34 (see FIG. 2). The arm segments may be formed with more angularly shaped bends, but the curves or bends are generally crescent shaped as illustrated herein. The distal ends 36 of the arm segments 32 are spaced apart from each other in each yoke 30 in order to form a gate for and permit a stem portion such as stem 38 to pass between them whenever that form of a cylindrical beverage holder is used.

Figure 4:
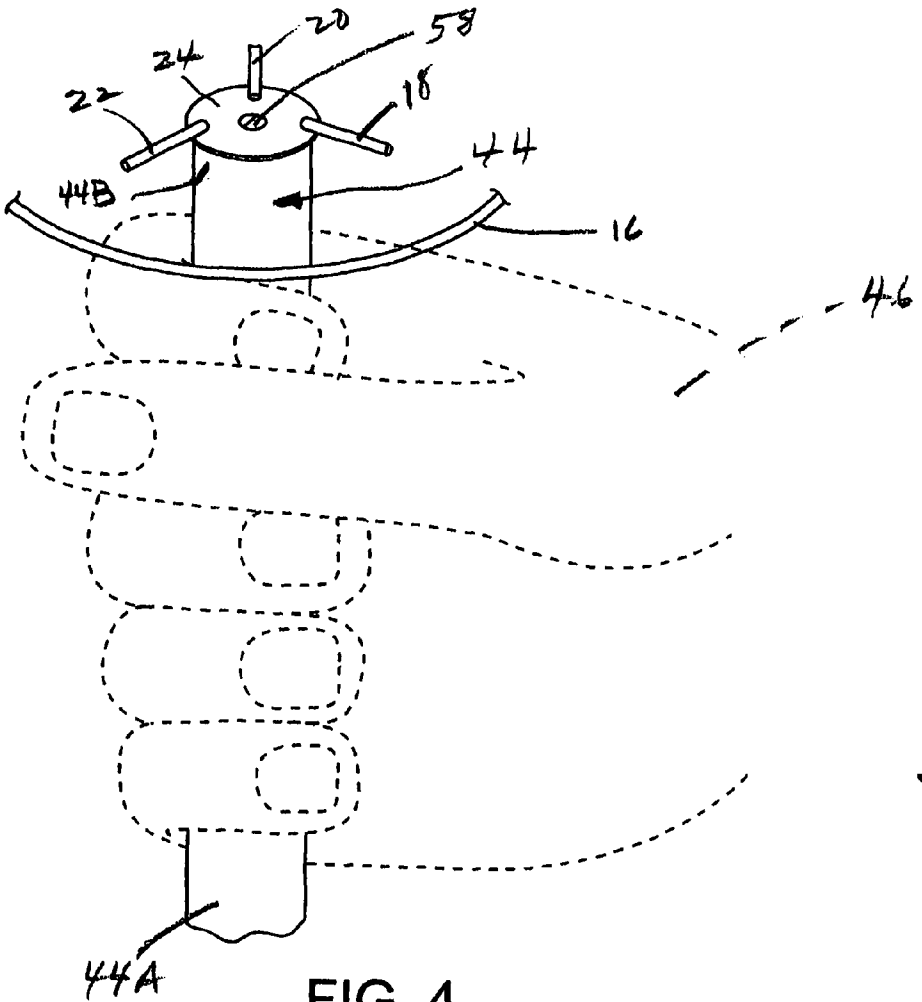
FIG. 4 is an enlarged view in perspective of a portion of the beverage service rack in FIG. 1 taken in the direction of arrows 4-4 in FIG. 1 and also showing a hand in phantom grasping the handle portion of the rack.

A handle portion 44 of the beverage service rack 10 is affixed to the underside of disk 24. Preferably, the handle portion 44 is a straight post or column as shown in FIG. 4. That form permits a person about to carry the rack to move his hand, as shown by hand 46, close to the underside of the tray portion 10A and permits him or her to use a closed portion of the grasping hand and also a forearm section to support the beverage service rack as it is being lifted or carried.

Figure 5:
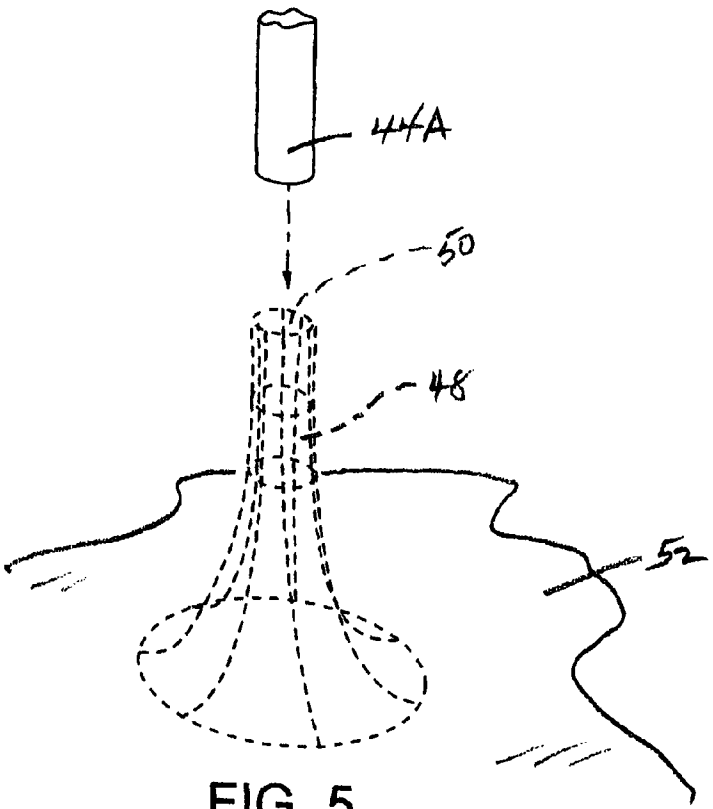
FIG. 5 is a perspective view of a distal end of the handle portion of the beverage service rack of FIG. 1 and also showing a stand in phantom arranged to receive the distal end of the handle.

Another advantage of a columnar form of handle 44 is that it may be used to mount the beverage service rack and display it in a table arrangement (see FIG. 5). A cage type holder 48 or similar supporting member, provided with an upwardly facing orifice 50, may be placed on a table, such as table 52, where a distal end 44A of handle portion 44 can be lowered into it.

Figure 7:
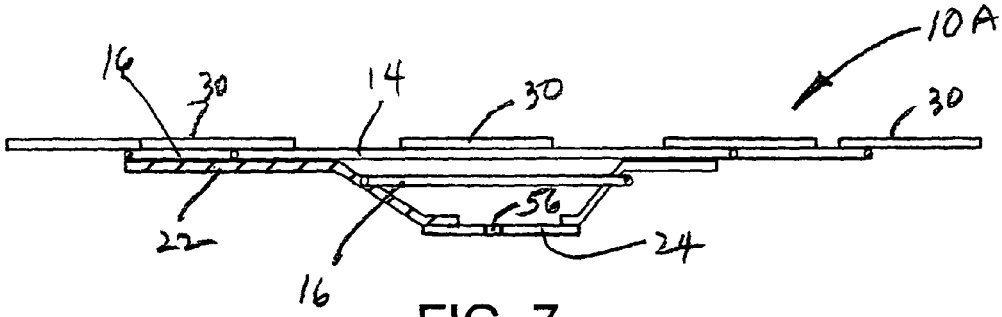
FIG. 7 is a sectional view of the tray portion of the beverage service rack of FIG. 1, taken along the line A-A in FIG. 6.
Figures 7A, 8:
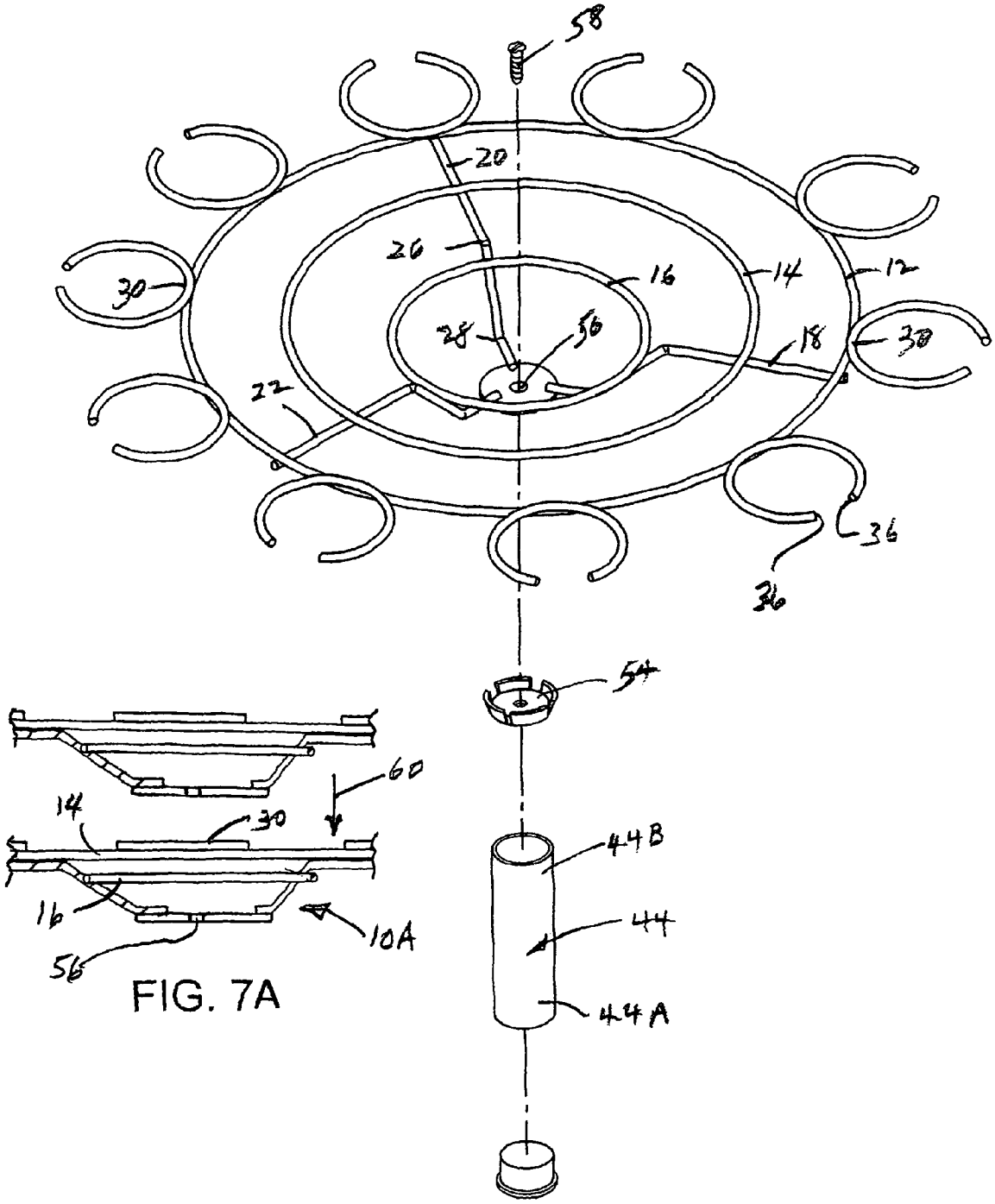
FIG. 7A is a view of like portions, partly broken away, of the tray portion shown in FIG. 7 and a second identical tray arranged to be nested together.
FIG. 8 is an exploded view, in perspective, of the beverage service rack of FIG. 1.
Figure 9:
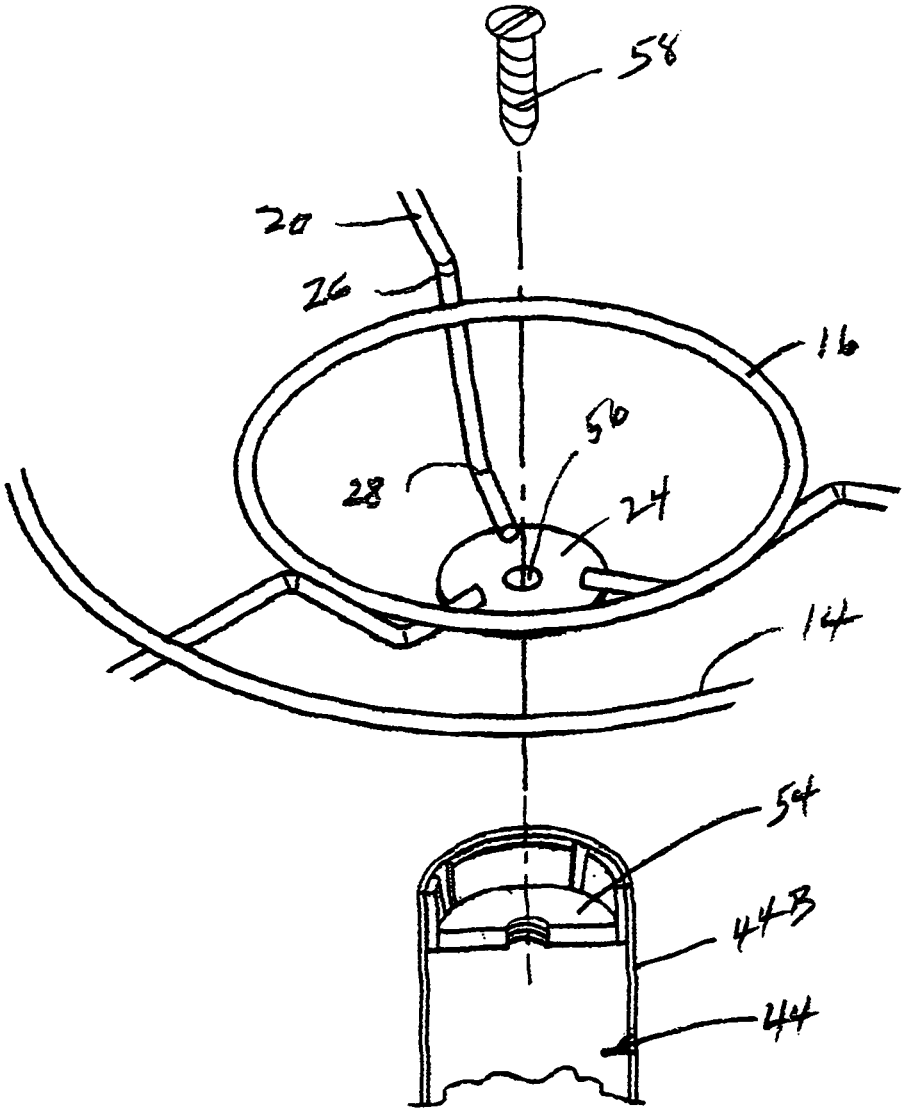
FIG. 9 is an enlarged exploded view in perspective, with portions partially broken away, of the beverage service rack shown in FIG. 8 illustrating a manner of assembling the tray portion of the beverage service rack to the handle portion.

The tray portions 10A and the handle portions 44 of the beverage service rack 10 are readily assembled, or disassembled for storage, as shown in FIGS. 8 and 9. The upper end 44B of handle portion 44 may be provided with an internally threaded member 54 (see FIG. 9) which is fixed in the handle portion 44. The disk 24 has a centrally located aperture 56 through which a threaded bolt 58 may be inserted from the upper side of the tray portion 10A. When bolt 58 is turned down, it forms a connection between the tray portion 10A and the handle portion 44 and brings disk 54 into a firm seating engagement on the upper end 44B of the handle. When assembled in this manner the beverage service rack may be placed in use, and when disassembled by removing bolt 58, the disassembled tray portions and handle portions are easily stored.

Figure 6:
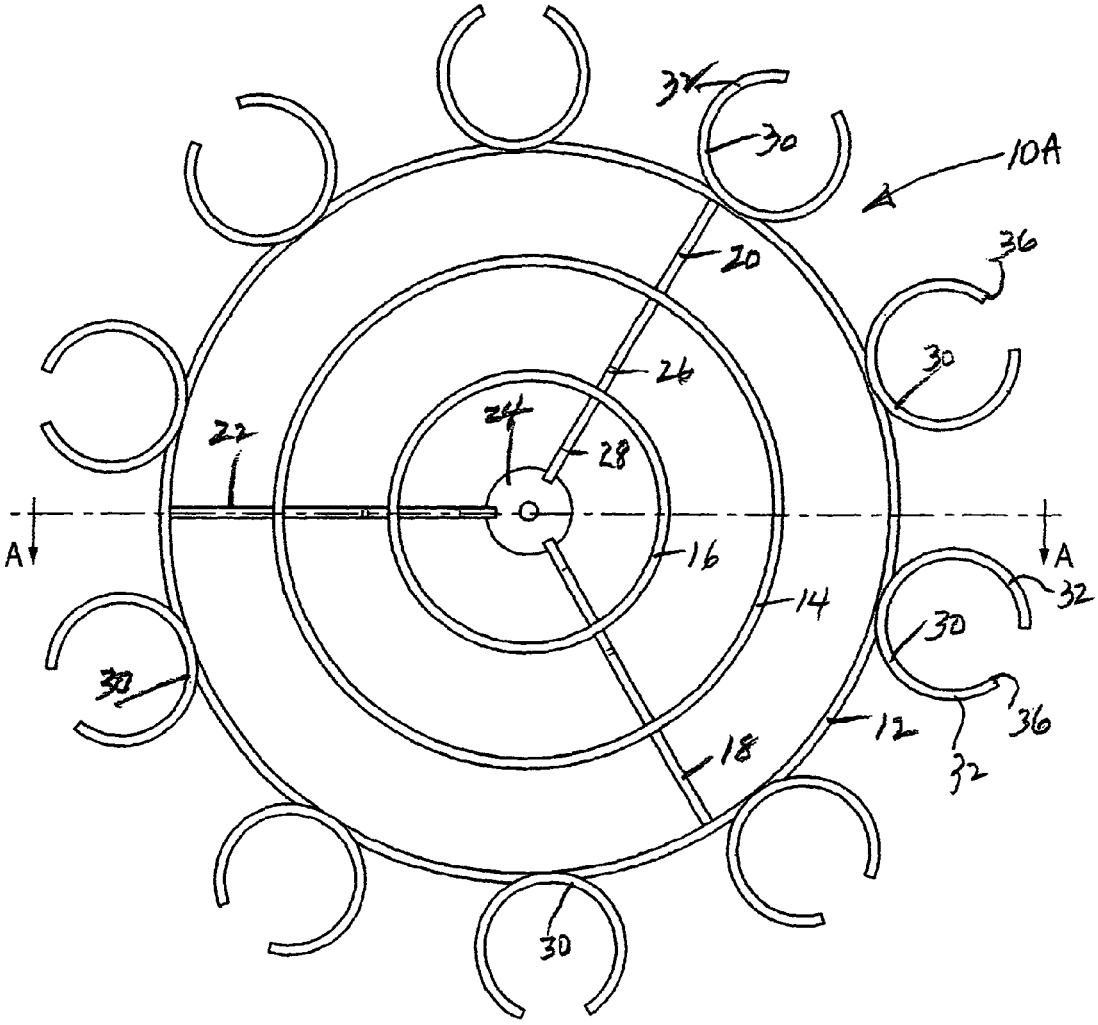
FIG. 6 is a plan view of the tray portion of the beverage service rack in FIG. 1.

FIGS. 6, 7 and 7A illustrate how the tray portions 10A conform to each other, when they are disassembled from their handle portions, and may be conveniently nested together. Each tray portion has a slightly recessed conically shaped center section due to the angular bends 26 and 28 in the arms, such as in arm 20. The center sections fit together when the underside of one tray portion is lowered in the direction of arrow 60 (see FIG. 7A) onto the upwardly facing side of an underlying tray portion. When they are nested together in this manner, the tray portions may be stored in a convenient, stable stack.

Although particular forms of this invention have been illustrated and described, nevertheless, various modifications can be made without departing from the true spirit and scope of the invention. Accordingly, no limitation is intended by the foregoing description, and its full breadth is intended to be covered in the following claims.

I claim:

1. A beverage service rack comprising a tray portion which includes a substantially planar deck formed of concentrically arranged ring members, a plurality of yokes on the deck having arm segments configured to receive and support cylindrical beverage holders nested in the arm segments, and a tray portion support member affixed to a first side of the deck comprising a hub section and arm members joined to and radiating from the hub section engaging the first side of the deck, a handle portion, and a connector on the handle portion engaging and separable from the hub section of the tray portion support member affixing the handle portion to or disconnecting the handle portion from the hub section.

2. The beverage service rack of claim 1 in which the handle portion is columnar.

3. The beverage service rack of claim 1 in which the handle portion extends downwardly from the first side of the tray portion and is formed to nest into an upwardly facing orifice of a table-top tray holder.

4. The beverage service rack of claim 1 in which the first side of the tray portion is configured to nest within an upwardly facing second side of a like tray portion.

* * * * *